US005624295A

United States Patent [19]

Watkins

[11] Patent Number: 5,624,295

[45] Date of Patent: Apr. 29, 1997

[54] CONFETTI LAUNCHING DEVICE

[76] Inventor: James O. Watkins, 14920 Mt. Nebo Rd., Poolesville, Md. 20837

[21] Appl. No.: 557,293

[22] Filed: Nov. 14, 1995

Related U.S. Application Data

[63] Continuation-in-part of Ser. No. 368,500, Jan. 4, 1995, Pat. No. 5,556,319, which is a continuation-in-part of Ser. No. 80,534, Jun. 24, 1993, Pat. No. 5,403,225, which is a continuation-in-part of Ser. No. 51,355, Apr. 23, 1993, Pat. No. 5,352,148.

[51] Int. Cl.[6] ..... A63H 37/00

[52] U.S. Cl. ..... 446/475; 124/5; 446/491

[58] Field of Search ..... 446/71, 75, 76, 446/475, 483, 491; 222/129, 156; 273/294; 124/5

[56] References Cited

U.S. PATENT DOCUMENTS

| | | | |
|---|---|---|---|
| 769,935 | 3/1904 | Brom | 446/359 |
| 814,367 | 3/1906 | Given | 446/126 |
| 825,843 | 7/1906 | Kliemandt . | |
| 1,153,207 | 9/1915 | Eisenberg . | |
| 1,491,809 | 4/1924 | Macchia . | |
| 1,881,916 | 10/1932 | Parker . | |
| 3,211,379 | 10/1965 | Burton | 215/388 |
| 4,078,328 | 3/1978 | Rayment | 446/126 |
| 4,976,367 | 12/1990 | Hoefler . | |
| 5,403,225 | 4/1995 | Watkins | 446/475 |

FOREIGN PATENT DOCUMENTS

| | | | |
|---|---|---|---|
| 361617 | 9/1906 | France | 446/475 |
| 10850 | 4/1903 | United Kingdom | 446/475 |
| 1306925 | 2/1973 | United Kingdom | 446/126 |

*Primary Examiner*—Robert A. Hafer
*Assistant Examiner*—Jeffrey D. Carlson
*Attorney, Agent, or Firm*—Ronald B. Sherer

[57] ABSTRACT

A wand is disclosed for launching confetti into the air which comprises an elongated hollow tube with axially extending slits forming flexible fingers at one end of the tube such that the fingers grip and hold stacks of confetti which are projected high into the air by centrifugal force upon waiving the end of the tube in an arcuate motion.

12 Claims, 3 Drawing Sheets

CONFETTI LAUNCHING DEVICE

This Application is a Continuation-In-Part of application Ser. No. 08/368,500 filed 4 Jan. 1995, now U.S. Pat. No. 5,556,319, which application was a Continuation-In-Part of application Ser. No. 08/080,534 filed 24 Jun. 1993, now U.S. Pat. No. 5,403,225, which, in turn, was a Continuation-In-Part of Ser. No. 08/051,355 filed 23 Apr. 1993, now U.S. Pat. No. 5,352,148; the complete disclosures of said Application and Patents being hereby incorporated by reference.

FIELD OF THE INVENTION

This invention relates to a device for launching confetti, and more particularly, to a reusable wand having a handle portion and a barrel portion from which barrel portion confetti is launched into the air by centrifugal force when the wand is waved forwardly in an arcuate motion with the arm and with a flick of the wrist.

BACKGROUND

My prior application Ser. No. 08/080,534, now U.S. Pat. No. 5,403,225, discloses an apparatus and method for launching confetti into the air by the simple act of waving a one-piece, hollow tube filled with confetti in a arcuate motion such that the confetti flies out of the tube under centrifugal force. The confetti is preferably in the form of unwrapped stacks of confetti pieces, or wrapped stacks of confetti hereinafter referred to as bundles. The confetti is preferably of four-sided shape such as the elongated tetragonal, and preferably rectangular, confetti as more fully disclosed in U.S. Pat. Nos. 5,403,225 and 5,352,148. The elongated hollow tubes disclosed in U.S. Pat. No. 5,403,225 are of constant diameter and are preferably filled with multiple stacks or bundles of confetti aligned in series along the length of the tube with each stack or bundle being in slight frictional contact with the interior wall of the elongated tube. For example, the shorter tubes, such as those in the order of 6 inches in length, generally contain in the order of 3 to 4 stacks or bundles per tube, while longer tubes, such as those in the order of 12 to 18 inches in length, generally contain in the order of 6 to 12 stacks or bundles per tube.

In use, such confetti-filled tubes are waved with the forearm and with a flick of the wrist one or more times until all of the stacks or bundles of confetti have been ejected from the tube high into the air. Once used, the empty plastic tubes have no further utility and thus become immediately disposable. Such tubes of constant diameter, sold under the trademarks FLUTTER-FLICKER for the shorter tubes and FLUTTER-FLINGER for the longer tubes, have been very commercially successful such that hundreds or even thousands of empty tubes may remain on the premises after use and disposal on the ground by fans at a sporting event, or by attendees at an amusement park or other event such as a parade. Such tubes have been composed of thin-walled, relatively rigid plastic, such as propionate or styrene, for example. While such plastics are ideal from a cost and manufacturing standpoint, the job of picking-up hundreds or a thousand empty plastic tubes presents an additional burden on the grounds keepers and maintenance personnel. Also, the frictional contact of all of the bundles with the interior surface of the tube tends to retard ejection of the later-ejected bundles which are located further from the open end of the tube.

One solution of this problem is disclosed in co-pending application Ser. No. 08/368,500 (now U.S. Pat. No. 5,556,319) which discloses a reusable confetti-launching wand in several embodiments. In some embodiments, the wand comprises a handle with a separable barrel, and in other embodiments the wand comprises an integral, tapered and/or flexible tube having a barrel portion and a handle portion. All of these embodiments are reusable and are very effective in launching unwrapped stacks or wrapped bundles of confetti high into the air; i.e., 20 feet or more. However, the manufacturing cost of wands with separable handles and barrels, as well as the manufacturing cost of tapered wands which must be molded, is much higher than the cost of the constant-diameter plastic tubes disclosed in U.S. Pat. No. 5,403,225.

SUMMARY OF THE INVENTION

The present invention eliminates all of the above-indicated disadvantages, while maintaining all of the advantages of launching confetti by a simple hand-operated device, by creating a reusable wand comprising a straight tube of constant diameter, and providing the straight tube with flexible fingers at the outlet of the barrel portion. The flexible fingers grasp the stacks or bundles of confetti and retain them in the barrel portion of the tube until centrifugal force builds up to the point where the frictional resistance of the fingers is overcome, at which point the stack or bundle of confetti is ejected high into the air. These and other objects and advantages of the invention will become more fully apparent from the following description of several preferred embodiments of the invention as further shown, by way of example, in the accompanying drawings.

DETAILED DESCRIPTION

Figure 1:
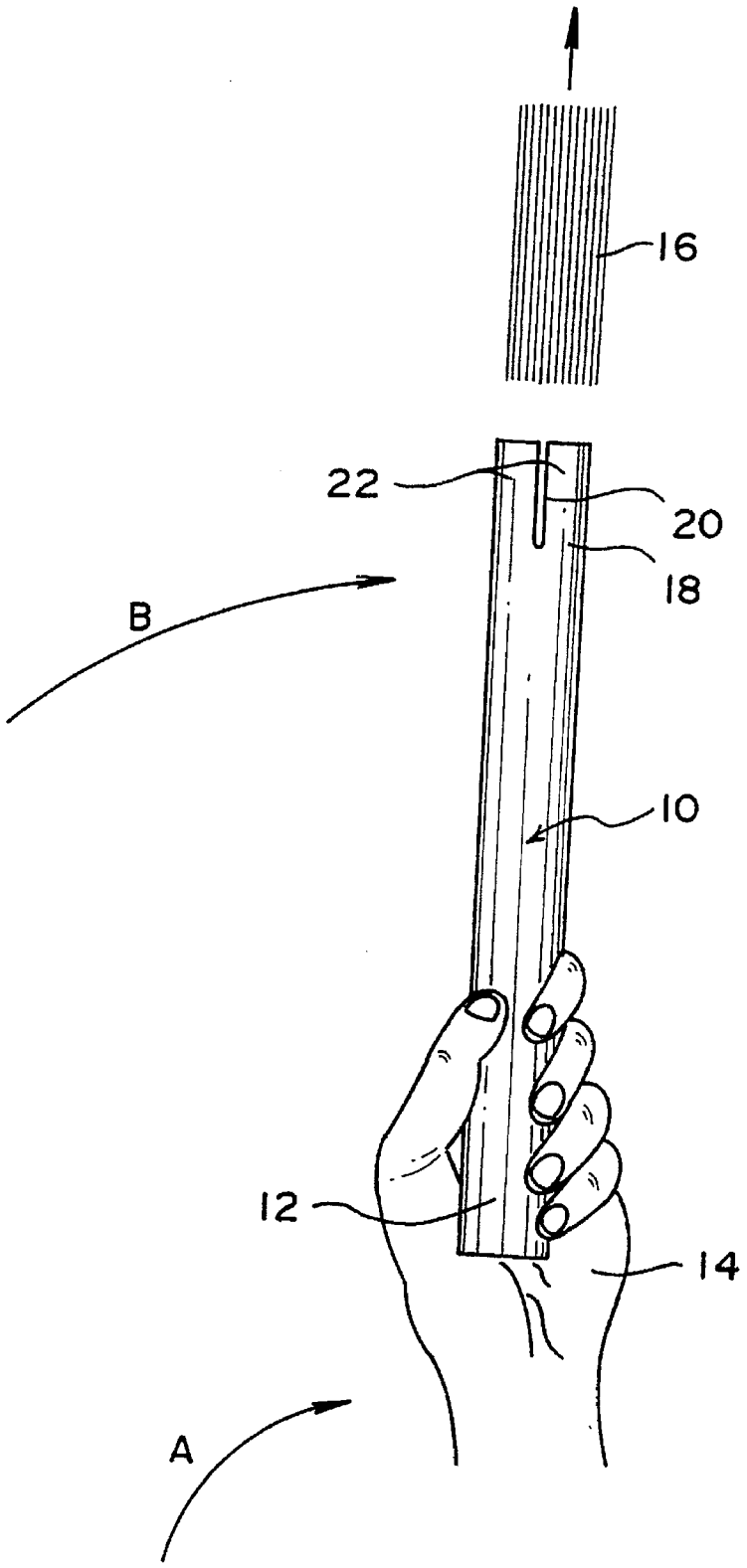
FIG. 1 is a schematic illustration of one form of the wand of the present invention in the hand of a user propelling a stack of confetti into the air.

Referring to FIG. 1, the handle portion 12 of wand 10 is shown in the hand 14 of a user as the user moves the forearm forwardly in the direction of arrow A, and with a flick of the wrist, such that the wand is moved rapidly in an arcuate path illustrated by arrow B. Such movement creates sufficient centrifugal force to eject confetti 16 from barrel portion 18 such that the confetti, preferably in the form of an unwrapped stack or wrapped bundle, is projected 20 or more feet into the air, at which point, the bundle or stack bursts into hundreds of individual pieces of confetti which flutter and float slowly to the ground in a dramatic visual display of color and motion simulating actual fireworks. Further details of preferred methods of forming stacks and wrapped bundles of confetti, and preferably end-wrapped bundles, are disclosed in the aforementioned Patents, as well as in U.S. Pat. No. 5,419,731, which is also incorporated herein by reference.

Figure 2:
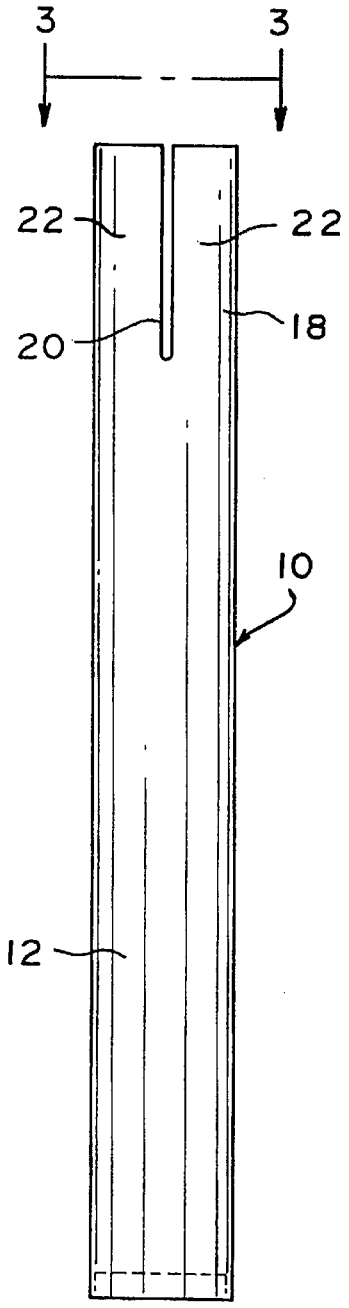
FIG. 2 is an elevational view showing the wand without a stack of confetti therein.
Figure 4:
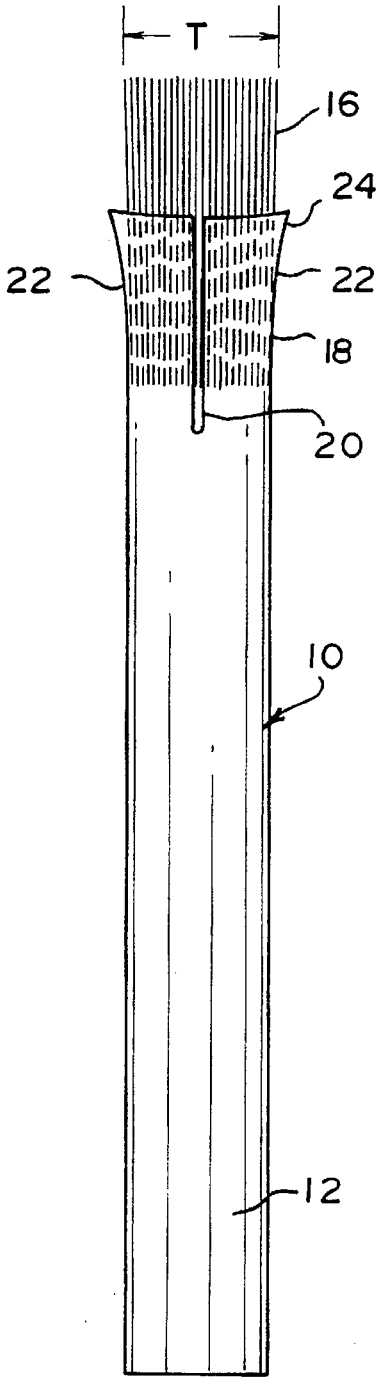
FIG. 4 is an elevational view showing the wand with a stack of confetti therein.

As further shown in FIG. 1, as well as in FIGS. 2 and 4, wand 10 comprises a straight, hollow tube of constant cross-sectional diameter, and the tube may be composed of relatively rigid plastic materials such as propionate or styrene as disclosed in U.S. Pat. No. 5,403,225. Alternatively, the tube may be composed of other relatively rigid materials such as spiral-wound cardboard, for example. However, the end of the tube comprising the barrel portion 18 is made flexible by the provision of slits or slots 20 such that the portions of the tube between the slits or slots become relatively flexible fingers 22. Fingers 22 are forced slightly outwardly by the insertion of a stack or bundle of confetti 16 which has a thickness T and/or width W such that the diagonal D is slightly greater than the internal diameter of the tube as shown most clearly in FIGS. 4 and 7. Thus, the stack or bundle of confetti 16 becomes frictionally held by the flexible fingers 22, and remains secured in the end of the wand, even though the wand may be pointed downwardly before or during movement of the arm in the arcuate motion leading up to the launch of the confetti. This builds up significant centrifugal force acting upon the stack or bundle of confetti such that it is not launched until the centrifugal force exceeds the frictional force of the flexible fingers, at which point the stack or bundle flies out of the barrel with substantial force and momentum because of the mass of the stack or bundle. As a result, the average adult can easily achieve heights of 20 feet or more, and even children or the elderly can achieve heights of 10–15 feet or more.

Figure 3:
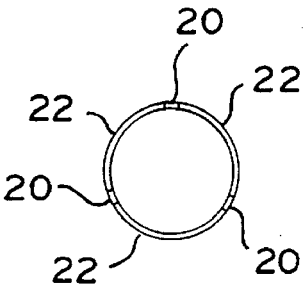
FIG. 3 is an end view taken along viewline 3—3 of FIG. 2.
Figure 5:
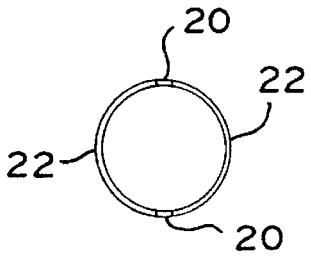
FIGS. 5 and 6 are end views showing alternative constructions of the fingers.
Figure 6:
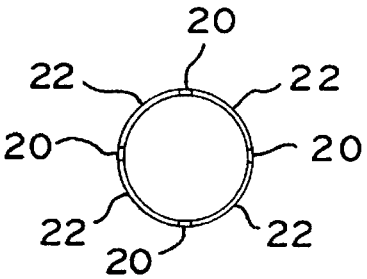

As shown in FIGS. 3, 5 and 6, the number of slits or slots 20 is preferably in the order of 2 to 4, and 3 slots as shown in FIG. 3 are most preferred. The slits 20 may be formed by cutting the barrel end 16 of the tube with a blade after the tube has been manufactured, and this allows the plastic tube to be manufactured by extrusion which is significantly cheaper than by molding. However, it is to be understood that the present invention also contemplates that the tubes may be molded, in which case, the slots 20 may be formed during the molding operation. Also, if the tubes are molded, the ends of the fingers may be formed with an outwardly flared portion 24 which further facilitates the insertion of the stack or bundle of confetti. However, such flared ends are not necessary in that the stack or bundle of confetti may be easily inserted by first pushing and spreading one of the fingers radially outwardly with an end edge of the stack or bundle, and then pushing and spreading a second finger outwardly by the other end edge of the stack or bundle until the full end of the stack or bundle slides between the slightly expanded fingers to the inserted position shown in FIG. 4.

Figure 7:
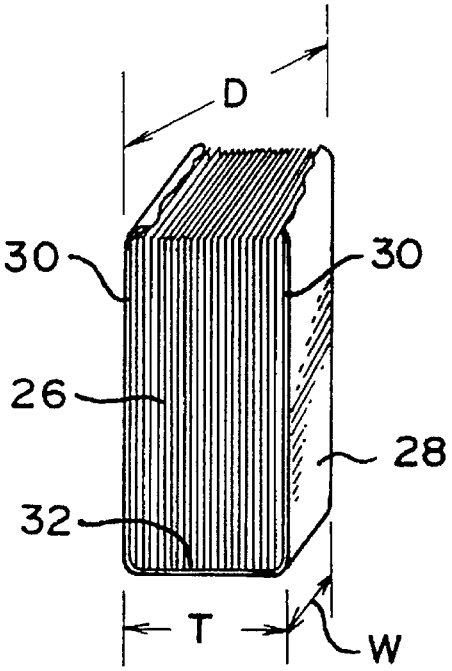
FIG. 7 is a perspective view of a partially wrapped bundle of confetti.

With regard to the preferred sizes of the wand of the present invention, it has been determined that the length of the wand should be in the order of 6 to 12 inches, although longer lengths are possible and can develop even more centrifugal force. The preferred diameter of the straight tube is in the order of 0.5 to 1.25 inches, although larger diameters are also possible for launching even larger stacks or wrapped bundles of confetti. With regard to the size of the stack or bundle relative to the diameter of the tube, it has been found by extensive experimentation that the diagonal D of the stack or bundle as shown in FIG. 7 should be in the order of 1/16 to 1/8 of an inch larger than the constant diameter of the tube. That is, it should be such as to firmly engage and hold the stack or bundle, while the fingers remain sufficiently flexible to launch the stack or bundle when the wand is essentially vertical as shown in FIG. 1. The handle end of the wand may be closed as shown ion FIG. 2, or open as shown in FIG. 4; the closed end being preferred since it adds further rigidity to the tube.

In addition to launching unwrapped stacks or wrapped bundles of confetti as described above, and more fully described in my prior patents incorporated hereinabove, it has been found that the wand of the present invention performs exceptionally well in launching partially wrapped stacks as disclosed in my co-pending application Ser. No. 08/273,115 filed 11 Jul. 1994, and now U.S. Pat. No. 5,531,628 which is hereby incorporated by reference. Such a partially wrapped stack is shown in FIG. 7 and comprises a stack 26 of elongated, tetragonal-shaped confetti which has a wrapper 28 which extends about the sides 30 and bottom end 32 of the stack, but the upper end 34 of the stack is not covered by the wrapper. Partially wrapped stacks are easy for the user to handle by holding the wrapped sides 30 between the fingers and inserting the wrapped bottom end 32 between the slightly spread fingers as previously described. Because the upper end 34 is not wrapped, the stack tends to burst apart more readily than a fully wrapped bundle of confetti. Therefore, the partially wrapped stack is advantageous for use in the home or in other buildings with relatively low ceilings. Completely unwrapped stacks may also be used in low ceiling environments, however, the unwrapped stack is sometimes more difficult for the non-professional user to insert quickly between the flexible fingers 22. For outdoor use, or in buildings with high ceilings such as convention centers and stadiums, the wrapped bundle is preferred because it remains in wrapped form longer and therefore achieves greater heights before unwrapping and bursting into hundreds of confetti pieces.

The partially wrapped stack may be prepared in any one of several methods. For example, stacks of confetti may be formed and then partially wrapped with a wrapper 28, however, this method is quite labor intensive. A more preferred method is to form the stacks with wrappers completely surrounding the sides and both ends of the stacks as a wrapped bundle as disclosed in my prior U.S. Pat. No. 5,419,731 hereby incorporated by reference. The portion of the wrapper covering one end is then torn off, either at the time of manufacture of the wrapped bundle, or by the user when the bundle is to be inserted into the wand, or immediately after it has been inserted by the user. This latter method has the added advantage that the user receives the confetti in wrapped bundles which may be used as such outdoors or in buildings with high ceilings, or the user has the option of tearing off the portion of the wrapper covering one end of the stack and using the partially wrapped bundle in environments having lower ceilings. In this regard, the present invention contemplates that the wand may be sold along with a number of wrapped bundles, such as a dozen or more, for example, and with instructions on how to prepare the partially wrapped stacks, and when to use fully wrapped bundles versus partially wrapped stacks versus removing the wrapper entirely and launching the unwrapped stack.

Figure 8:
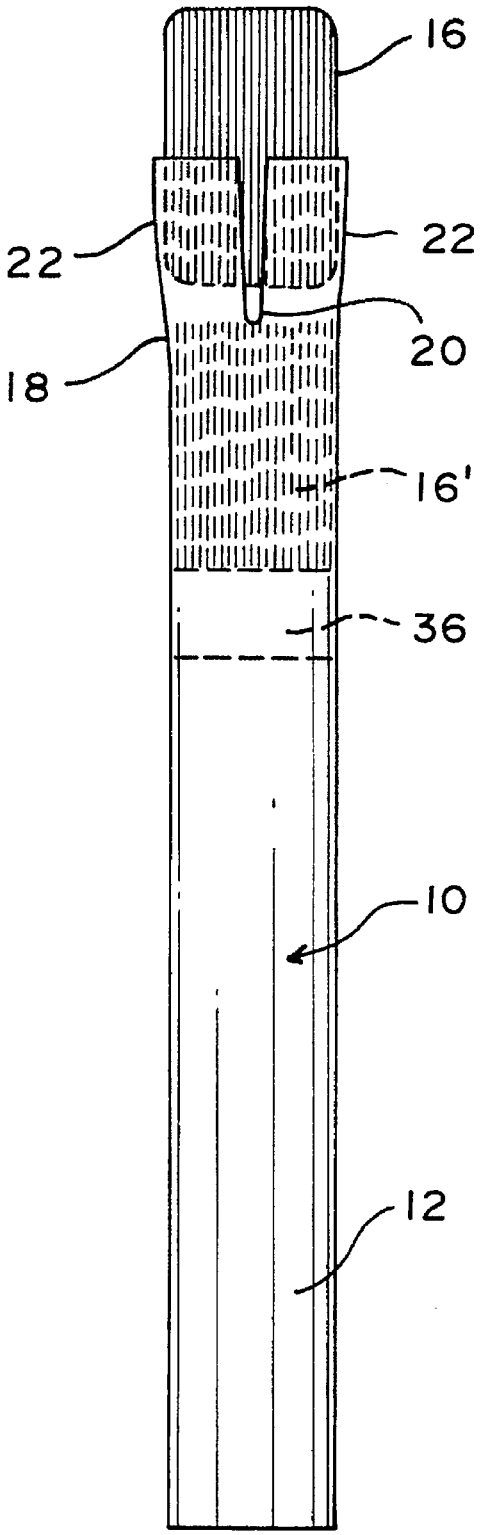
FIG. 8 is an elevational view showing a further embodiment of the invention.

In the foregoing description of the first preferred embodiment of the wand of the present invention, it has been assumed that the wand would be used to launch only one stack or bundle of confetti at a time. However, as shown in FIG. 8, a second, or even a third, stack or bundle 16' may also be inserted in the tube and launched at the same time as stack or bundle 16. In order to accomplish this with a straight tube of constant diameter, a stopper 36 is inserted into the tube for the purpose of preventing such second or third stack or bundle from entering the lower handle portion 12. Stopper 36 may be a crumpled and balled piece of paper, or a piece of rubber or plastic foam or a ball or disc of other resilient material having a diameter slightly larger than the internal diameter of the tube such that, once the stopper is pushed into place with a stick or rod, it remains in that place during use of the wand. Second or third stack or bundle 16' is then inserted in the tube and it is preferred that the diagonal of stack or bundle 16' is selected so as to be essentially equal to, or slightly less than, the constant internal diameter of the tube. Therefore, unlike the compressed stacks in the tubes of my U.S. Pat. No. 5,403,225, which are in sufficient frictional contact with the internal tube wall so as to not slide out when the tube is pointed downwardly, the teaching of this invention is to size the thickness and width of the stacks or bundles 16' so as to be loosely contained in the wand. That is, the size of the stacks or bundles are such as to readily slide out of the wand if they were not retained in place by stack or bundle 16 secured by flexible fingers 22.

It will be understood that the operation of the FIG. 8 embodiment is the same as that of the FIG. 1 embodiment, except that upon ejection of bundle 16, the unrestrained second or third bundle 16' also flies out with great force and momentum such that the two or three stacks or bundles all achieve essentially the same height of 20 feet or more and each stack or bundle bursts into a starburst of hundreds of pieces of confetti.

From the foregoing description of several preferred embodiments, it will be apparent that the present invention provides a straight tube of constant diameter, which may be formed by extrusion at very low cost, and which can launch 1 to 3 stacks or bundles of confetti to great heights by simple arm and wrist movement. Of course, it will become apparent to those skilled in the art that numerous changes and variations may be made in the illustrated embodiments. Therefore, it is to be understood that the foregoing description of several embodiments of the invention are intended to be illustrative of the principles of the invention, rather than exhaustive thereof, and that the invention is not intended to be limited other than as expressly set forth in the following claims interpreted under the doctrine of equivalents.

What is claimed is:

1. A wand means for launching confetti upwardly into the air comprising:

(a) an elongated hollow tube of constant diameter having a longitudinal axis;

(b) said hollow tube having a handle portion and a barrel portion;

(c) a plurality of slits in said barrel portion of said hollow tube, said slits extending parallel to said longitudinal axis of said tube and forming flexible finger portions extending axially along said barrel portion and, (d) a stack of confetti of a size and shape such as to be insertable between said flexible finger portions.

2. The wand means of claim 1 wherein said slits comprise three slits, said three slits being essentially equally spaced around the circumference of said tube.

3. The wand means of claim 1 wherein said tube is comprised of extruded plastic.

4. The wand means of claim 1 wherein said tube is comprised of cardboard.

5. The wand means of claim 1 wherein said tube is comprised of molded plastic, and wherein said slits comprise slots molded into said tube.

6. The wand means of claim 5 wherein the ends of said flexible finger portions are flared outwardly.

7. A wand for launching confetti upwardly into the air comprising in combination:

(a) an elongated hollow tube of constant diameter having a longitudinal axis;

(b) said hollow tube having a handle portion and a barrel portion;

(c) said barrel portion having a plurality of axially extending slits spaced about the circumference of said barrel portion forming flexible finger portions of said barrel; and (d) a stack of confetti, said stack of confetti having a diagonal sufficiently greater than the constant diameter of said tube such that said stack of confetti forces said finger portions radially outwardly upon insertion of said stack of confetti into said barrel portion whereby said stack of confetti remains frictionally engaged by said finger portions until centrifugal force overcomes said frictional engagement upon arcuate movement of said wand such that said stack of confetti is launched high into the air.

8. The wand of claim 7 wherein the diagonal of said stack of confetti is in the order of 1/16 to 1/8 inches greater than the diameter of said tube.

9. The wand of claim 7 wherein said stack of confetti comprises a large plurality of pieces of confetti, each of said pieces of confetti being of elongated tetragonal shape having lengths and widths and having first and second faces, and said pieces of confetti being stacked in face-to-face relationship with said lengths in parallel, and wherein the number of said pieces of confetti determine the diagonal of said stack.

10. The wand of claim 7 further including a second stack of confetti, said second stack being positioned in said tube between said first stack and said handle portion.

11. The wand of claim 9 wherein said stack of confetti is wrapped by a wrapper to form a wrapped bundle of confetti.

12. The wand of claim 9 wherein said stack of confetti is partially wrapped by a wrapper, said wrapper extending over two sides and the bottom of said stack.

* * * * *